US007861473B1

(12) United States Patent
Green

(10) Patent No.: US 7,861,473 B1
(45) Date of Patent: Jan. 4, 2011

(54) LOW-PROFILE SCREEN FRAMING SYSTEM

(75) Inventor: Guerry E. Green, Pawley's Island, SC (US)

(73) Assignee: Marhaydue, LLC, Pawleys Island, SC (US)

( * ) Notice: Subject to any disclaimer, the term of this patent is extended or adjusted under 35 U.S.C. 154(b) by 43 days.

(21) Appl. No.: 12/353,313

(22) Filed: Jan. 14, 2009

(51) Int. Cl.
*E06B 1/18* (2006.01)
*E06B 1/32* (2006.01)
*E06B 9/00* (2006.01)

(52) U.S. Cl. ..... 52/210; 52/204.1; 52/211; 52/582.1; 52/586.1; 52/717.01

(58) Field of Classification Search ..... 52/204.1, 52/210–213, 287.1, 311.1, 311.2, 311.3, 52/459, 582.1, 586.1, 585.1, 586.2, 716.1, 52/717.01, 718.01, 718.02, 204.61, 204.5
See application file for complete search history.

(56) References Cited

U.S. PATENT DOCUMENTS

| | | | | | |
|---|---|---|---|---|---|
| 1,745,818 | A | * | 2/1930 | Trombly et al. | 160/394 |
| 2,034,265 | A | * | 3/1936 | McLaughlin, Jr. | 52/206 |
| 2,396,295 | A | * | 3/1946 | Spraragen | 160/40 |
| 2,770,334 | A | * | 11/1956 | Rust et al. | 52/784.1 |
| 2,858,602 | A | * | 11/1958 | Johnson | 29/413 |
| 3,489,199 | A | * | 1/1970 | Weikel et al. | 160/90 |
| 3,497,029 | A | * | 2/1970 | Stark | 181/30 |
| 4,038,791 | A | | 8/1977 | Atkinson | 52/36 |
| 4,274,234 | A | | 6/1981 | Abell | 52/63 |
| 4,503,640 | A | | 3/1985 | Stern | 49/425 |
| 4,899,797 | A | | 2/1990 | Green | 160/395 |
| 5,046,546 | A | | 9/1991 | Benedyk et al. | 160/371 |
| 5,143,138 | A | | 9/1992 | Zwart | 160/395 |
| 5,802,800 | A | | 9/1998 | Meyers | 52/731.21 |
| 5,904,022 | A | | 5/1999 | Zadok | 52/650.1 |
| 5,910,084 | A | | 6/1999 | Koike et al. | 52/204.1 |
| 6,006,489 | A | * | 12/1999 | Zadok | 52/773 |
| 6,192,643 | B1 | | 2/2001 | Zadok | 52/648.1 |
| 6,295,783 | B1 | | 10/2001 | Davis | 52/736.3 |
| 6,385,941 | B1 | | 5/2002 | Power, Jr. et al. | 52/731.3 |
| 6,412,250 | B2 | | 7/2002 | Davis | 52/736.3 |
| 6,618,998 | B1 | * | 9/2003 | Thomas et al. | 52/63 |
| 6,668,495 | B1 | | 12/2003 | Prince | 52/63 |
| 6,945,305 | B1 | | 9/2005 | Limauro | 160/369 |
| 2005/0236120 | A1 | | 10/2005 | Johnson | 160/404 |
| 2007/0145340 | A1 | * | 6/2007 | Brabeck et al. | 256/24 |
| 2008/0172978 | A1 | * | 7/2008 | Caruso | 52/716.8 |

* cited by examiner

*Primary Examiner*—Jeanette E. Chapman
(74) *Attorney, Agent, or Firm*—Sara C. Kanos; Nexsen Pruet, LLC

(57) ABSTRACT

A system for framing a porch using concealed fasteners and concealed or partially-concealed framing elements on support posts. The framing elements have a small cross section, generally shaped like the letter C with a slot on one side and a spline groove in one of the opposing corners. The framing elements are attached to a support post by screwing plural, spaced-apart buttons into the posts and then snapping the button heads into the slot of the framing elements. The framing elements may be applied to the surface of the posts or, because of their small size, may be put into grooves formed in the sides or corners of the posts and concealed on one or more sides by trim boards.

28 Claims, 5 Drawing Sheets

LOW-PROFILE SCREEN FRAMING SYSTEM

BACKGROUND OF THE INVENTION

The present invention relates to framing systems for fixed screens and, more particularly, to low-profile frame members for fastening screens to framing such as are used for porches.

Screened porches remain a popular addition to constructions, as they enhance the enjoyment of the out-of-doors regardless of ambient conditions. The screening blocks the entry of insects and admits air to the area of the porch so enclosed. Typically, porches are screened by erecting a simple wooden framing to enclose the porch in a series of panels and to which the screening material is nailed or tacked. Additionally, screened enclosures often utilize beams and posts or columns in their construction. Both the fasteners employed to erect the porch and the post and beam construction contributes to an unfinished appearance. It is thus desirable to conceal these features to enhance the appearance and enjoyment of the screen porches.

In some areas of the country, such as along the sea coast and other areas that afford a view of the outdoors, multi-level screen porches are both common and preferred. Elaborate and complex framing techniques must be used to erect such porches. This framing may require the use of furring strips to cover attaching means, which further increases the cost and installation time. Moreover, the installation of the screen, as well as ongoing maintenance, must be done at elevated, potential dangerous heights. Ladders must be employed, which contributes to the unstable and inconvenient aspects of installing and maintaining multi-level porches.

A number of other devices exist to attach screening to frames. Many of these are asymmetric so that they must be carefully oriented before being fastened to the framing. Some require two installers for proper installation. Some such devices are available as a set of elements, each of which is suited for a different part of a porch configuration: one element for outside corners, one for inside corners, one for intermediate frame members, and so forth. Some are difficult to install, are obtrusive or lack a finished appearance. Additionally, special mounting procedures to attach screens to frames may need to be employed, which further complicates the process of erecting screen porches.

Accordingly, there remains a need for a framing system that can easily fasten screens to framing while also maintaining a finished, aesthetically pleasing look to the finished screened porches or areas.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects, and briefly stated, the present invention is a system for attaching screening to a framework. In particular, the system includes a button with a separate or integral screw and a frame element that are combined with a support member within a framework. Alternatively, the system can include only a screw or a clip that functions as both a button and screw. The frame element includes a slot cut in one side and a spline groove formed in a corner of the opposing side. The slot and button are dimensioned so that the slot will receive the button when the frame is snapped or pressed down over the button.

The framework of the system can include a variety of support members, including posts. When a row of spaced-apart buttons is screwed into a support member of the framework, such as 4×4, 6×6 or 8×8 inch wooden posts, for example, the frame element, slot-side-down, can be snapped onto the row of buttons to be held fast. A section of screening material can then be attached and held to the frame element by pressing the edge of the screen into the spline groove of that frame element with a spline to hold the screen in the groove.

The frame element is also dimensioned so that a thin trim board can conceal it, either from external view or by being placed next to it so that the frame element does not extend above the surface of the trim board, thus giving the appearance of the screen extending directly out of or being integral with the trim board. Alternatively, the framework can be routed to provide a recess for receiving the frame element within the envelope defined by the original dimensions of the framework.

A feature of the present invention includes the use of a framing system that conceals fasteners. When erecting screen porches, numerous fasteners, such as nails and screws must be used to erect the framing and to connect the screening to the framing. The present system provides a simple and effective means to conceal the fasteners, and alleviates the need for furring strips. In particular, the only fasteners needed to attach the screening to the framing are the buttons and screws. These fasteners are completely covered by the frame element once the slot is snapped in place.

Another feature of the present invention includes the use of a framing system connected to the main structural framing that operates as a secondary frame to support the screen. Typically, screening must be attached directly to the main frame members, such as 2×2 wooden posts, that form the main frame of the porch. In the present system, the frame element provides a means to attach screening that is secondary to the main frame. This provides flexibility in the construction process. Moreover, the frame system of the present invention can be installed from inside of the porch, which greatly increases the convenience and safety of installation, as well as the ongoing maintenance of the porch.

Still another feature of the present invention includes the use of a framing system that is itself concealed within a frame work by other construction elements, including trim boards. To create a flush and finished appearance, the frame element of the present invention is small enough and dimensioned to be hidden from view by trim boards. Accordingly, the frame elements are preferably no thicker or wider than the trim boards. The trim boards can be made of structural framing materials, and can be made in a variety of sizes and colors. Preferably, the trim boards of the present system are about ¾ inches thick, either wood or synthetic material in suitable trim colors. Especially in those porches intended for the enjoyment of views to the outside, such as ocean views, the less obstruction to these views the better.

Yet another feature of the present invention includes the use of a frame element that can be concealed within a framework through the use of routed support elements. In particular, support members can include cut-outs having dimensions that are about the same as those of the frame element, so that the frame element is received by and concealed within the support members. The result is a flush and much more finished appearance for the framework of a screen-in porch and yet one that still allows the screens to be easily replaced as needed. Accordingly, this feature provides flexibility in construction choices, while still maintaining an aesthetically pleasing structure.

Another feature of the present invention includes the use of a button that is dimensioned to be received by the slot of the frame element so that the frame element can be attached to a variety of frameworks. The buttons can be made of plastic, such as nylon, either with a hole for a conventional metal screw or with an integral screw of plastic. The head of the button is shaped to allow the frame element to be easily snapped over it; that is, the button is just slightly larger than the width of the slot. Alternatively, the button can be a clip that is one-piece, having a head portion and a post portion.

Yet another feature of the present invention includes the use of a frame element that includes a slot cut in one side and a spline groove formed in a corner of the opposing side. The frame element preferably has a square cross section in the shape of a squared letter C with the opening of the C defining the slot. Opposite the slot in one corner or the other is a spline groove. The frame element is preferably made of metal, but may also be made of plastic. If made of metal, it is preferably powder-coated painted in any one of a variety of colors. Additionally, the frame element is preferably less than one inch on one side, but can also be other sizes depending on the size and dimension of the framework.

Other features and advantages of the present invention will be apparent to those skilled in the art from a careful reading of the Detailed Disclosure of the Preferred Embodiment presented below and accompanied by the drawings.

DETAILED DESCRIPTION OF THE PREFERRED EMBODIMENT

Figure 1:
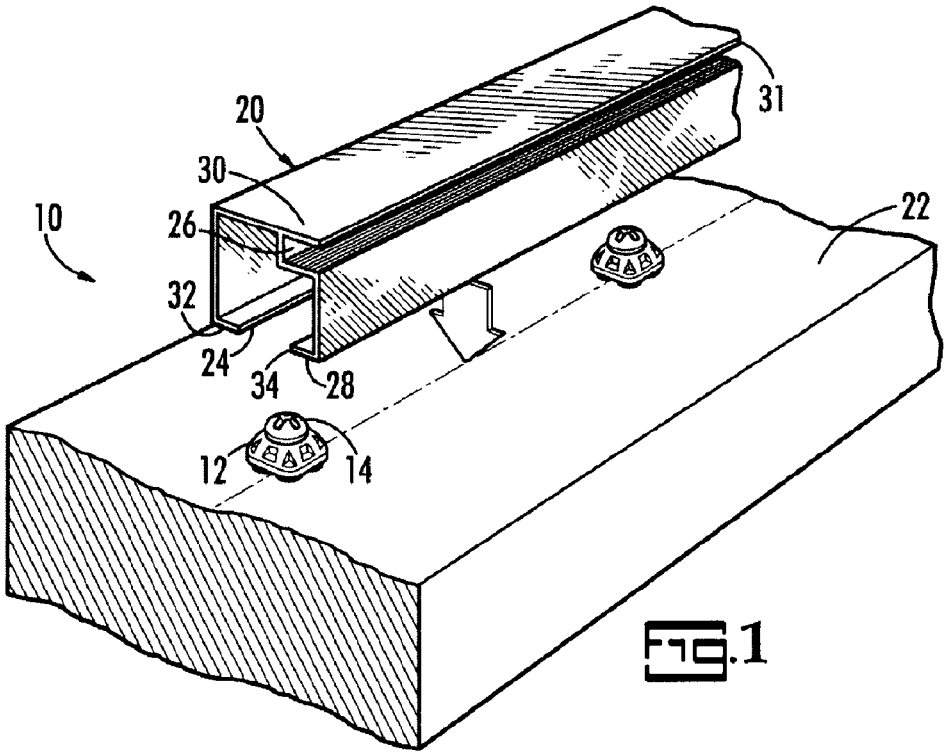
FIG. 1 is an exploded perspective view of a screen framing system according to a preferred embodiment.

The present invention is a system for attaching screening to a framework. As illustrated in FIG. 1, the framing system 10 includes a button 12 with a separate or integral means for attaching, such as a screw 14, and a frame element 20 that are combined with a support member, such as a post 22, of a framework. The frame element 20 preferably has a square cross section in the shape of a squared letter C with the opening of the C defining a slot 24 cut into one side 28 of frame element 20 that extends longitudinally along the length of frame element 20. In a corner 31 of the opposing side 30 of frame element 20 is a longitudinally extending spline groove 26. The spline groove 26 preferably has a U-shaped cross section and is defined by an upper wall 36 and lower wall 38 spaced apart and connected by a side wall 37. Preferably, the surfaces of upper and lower walls 36, 38 are ridged to better retain splines and screens by frictional engagement when these features are applied.

Preferably, the frame element 20 is made of metal, although other materials, including plastic, are contemplated. However, other materials are suitable for making the frame element 20, including fiberglass materials. If made of metal, the frame element 20 is preferably powder-coated painted in any one of a variety of colors. Additionally, the frame element 20 is preferably less than about one inch on one side 28, but can also be a variety of sizes depending on the size and dimension of the framework. Importantly, the dimensions of the frame element 20 are such that the frame element 20 can be easily concealed by other structural or support elements within a framework. The button 12 can be made of plastic, such as nylon, either with a hole 13 (shown in FIG. 4) for a conventional metal screw 14 or with an integral screw of plastic. Suitable posts 22 for the framing system 10 include, but are not limited to 4×4, 6×6 or 8×8 inch wooden posts.

Figure 2A:
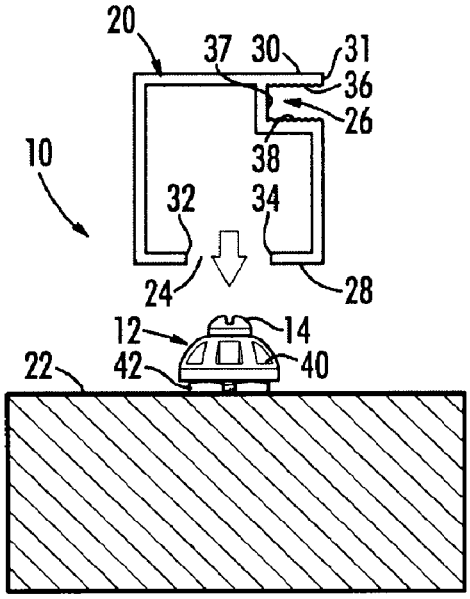
FIG. 2A is an exploded top view of a screen framing system according to a preferred embodiment.
Figure 2B:
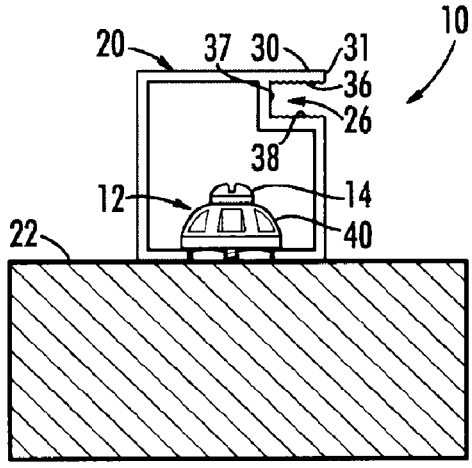
FIG. 2B is a top view of a screen framing system according to a preferred embodiment.
Figure 2C:
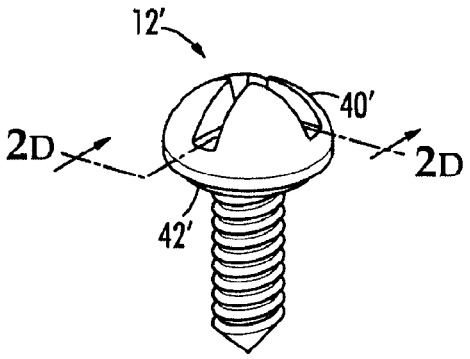
FIG. 2C is a perspective view of a button according to a preferred embodiment.
Figure 2D:
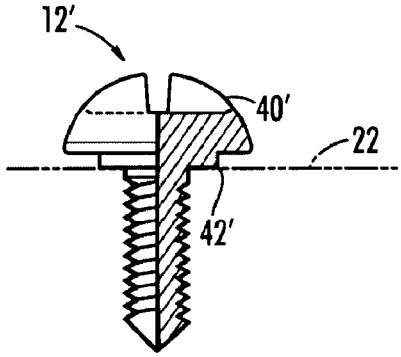
FIG. 2D is a partial cross-sectional view of a button taken at Line 2-D according to a preferred embodiment.

As shown in FIGS. 2A-2B, the slot 24 and button 12 are dimensioned so that the slot 24 will receive the button 12 when the metal frame element 20 is snapped or pressed down over the button 12. The button 12 includes a head 40 and a base 42. Although a variety of shapes is contemplated for the button 12, to facilitate the snap fit of the frame element 20, the head 40 is generally rounded and the base 42 is generally narrower than the head 40. In particular, side edges 32, 34 of frame element 20 defining slot 24 are held fast by the head 40 of button 12, which overlaps each edge 32, 34. When the frame element 20 is snapped in place, the edges of frame element 20 spring apart at slot 24 as they ride down over the rounded head 40, and then spring back together once head 40 has passed through slot 24. Alternatively, the button 12 can be a clip or a one-piece screw 12' (shown in FIGS. 2C-2D) having a head portion 40' for receiving the slot 24 and a base 42' and post portion that is received by the post 22.

As described, an important feature of the present invention includes the use of a framing system that can conceal fasteners. In particular, the only fasteners needed to attach the screening to the framing are the buttons 12 and screws 14 or one-piece screw 12'. These fasteners are completely covered by the frame element 20 once the slot 24 is snapped in place.

Figure 3:
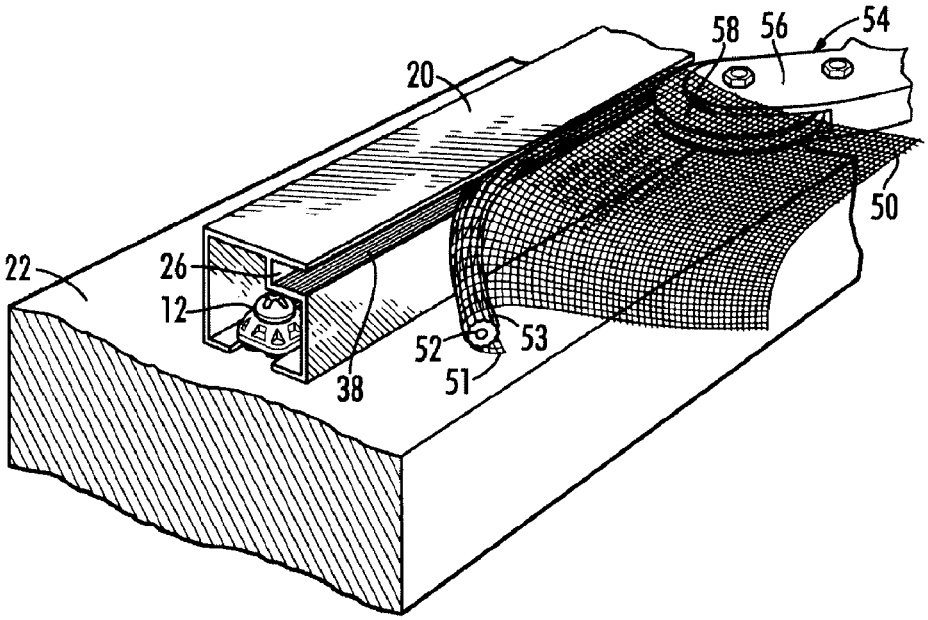
FIG. 3 is a perspective view of a screen framing system according to a preferred embodiment.

A number of methods and construction tools can be employed to apply screening to the frame element 20. As illustrated in FIG. 3, for example, when a row of spaced-apart buttons 12 is screwed into post 22 of the framework, the frame element 20, slot-side-down, can be snapped onto the row of buttons 12 to be held fast. A section of screening material, such as a wire or meshed screen 50, can then be connected to the frame element 20 by pressing the edge of the screen 50 into the spline groove 26 of that element 20 with a spline 52 to hold the screen 50 in the groove 26. As illustrated, a marginal portion 51 of screen 50 surrounds a major portion of spline 52, which is preferably resilient and cylindrical with a series of teeth 53 about its exterior surface. Spline groove 26 is sufficiently narrow so that a spline received therein is held in place; that is, groove 26 can hold spline 52 with screen 50 and exert a small amount of tension on spline 52 without spline 52 slipping out of groove 26. Furthermore, spline teeth 53, which can frictionally engage ridged surfaces of upper and lower walls 36, 38, also facilitate in securing the screen 50 within the spline groove 26.

An assembly tool 54 can also be employed to facilitate attaching the screen 50 to the frame element 20. Preferably, the tool 54 includes a handle 56 connected to circular spline press 58 that is rotatably mounted to the handle 56. The spline press 58 is dimensioned to receive the spline 52 and force the spline 52 into the groove 26 when downward pressure is exerted by the user and the tool 54 is rolled along the length of the spline groove 26.

Another feature of the present invention is that the frame element 20 is dimensioned so that structural framing members, such as trim boards, conceal it and so that the frame element 20 conceals the button 12 or other attaching means from external view. Preferably, the frame element 20 is connected to the main structural frame members, such as posts, and other construction members, such as trim boards, are included and positioned in relation to the main frame and the frame element 20 so that the frame element 20 does not extend above the surface of any of the framing members. The resulting appearance is that of the screen 50 extending directly out of or being integral with the framework. Alternatively, the members of the framework can be routed to provide a recess for receiving the frame element 20 within the original dimensions of the framework. When trim boards are used, they are preferably made of structural framing materials, and can be made in a variety of sizes and colors. Preferably, the trim boards of the present system are about ¾ inches thick, either wood or synthetic material in suitable trim colors. These dimensions are important to prevent obstructions to views from within the porch.

Accordingly, FIGS. 4-9 illustrate three alternative frameworks into which the present framing system 10 can be employed. Although only the intermediate frame members of overall frameworks are shown in the drawings, the present invention contemplates the system being used in any portion of screened framework, including inside corners, outside corners, and so forth. Importantly, each of the alternative frameworks emphasizes the concealable frame element 20 feature of the present invention. As shown FIGS. 4-9, to create a flush and finished appearance, the frame element 20 completely covers the buttons 12 and screws 14 from view. Preferably, the spline groove 26 and spline 52 are also hidden from external view when the frame element 20 is connected to a main frame member. Furthermore, the frame element 20 is small enough and dimensioned to either be hidden from view by construction members, such as trim boards, or to fit within traditional routed support elements. The result is a finished, aesthetically pleasing appearance. Accordingly, the frame element 20 is preferably no thicker or wider than a trim board. The dimensions of the frame element 20, however, will ultimately depend on the dimensions of the frame members employed, as well as the screen that is to be attached. This feature provides flexibility in construction choices, while still maintaining a visually pleasing structure.

Figure 4:
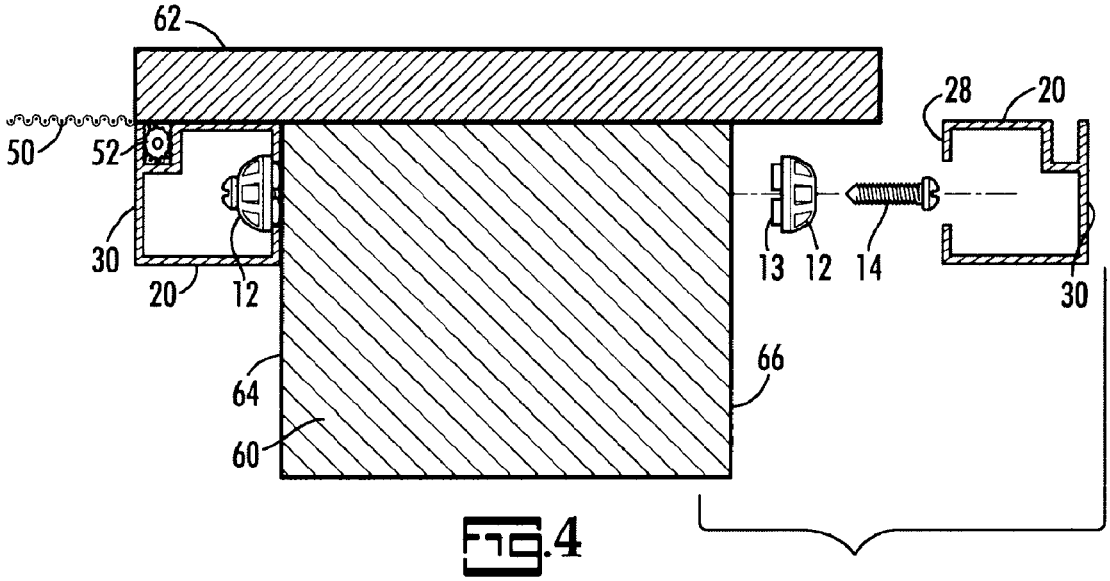
FIG. 4 is an exploded top view of a screen framing system combined with a support member of a framework according to an alternative embodiment.
Figure 5:
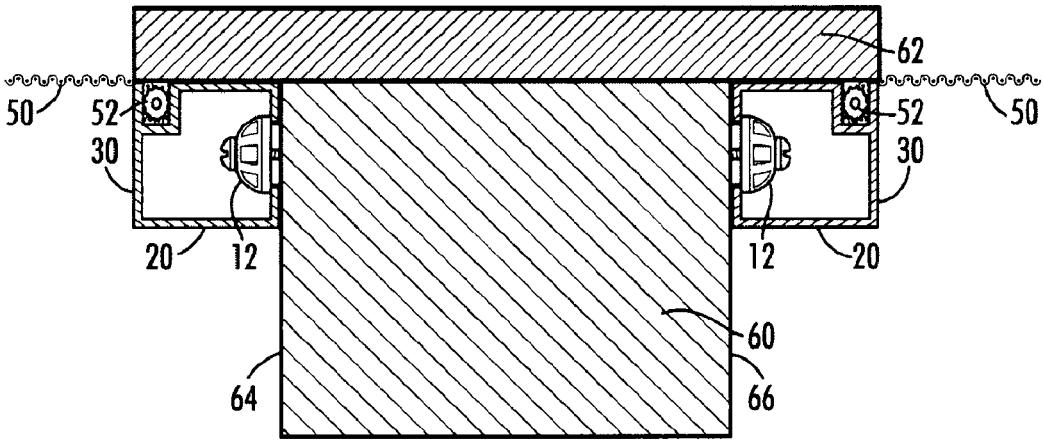
FIG. 5 is a top view of a screen framing system combined with a support member of a framework according to an alternative embodiment.

In a first embodiment shown in FIGS. 4-5, framing system 10 is combined with a support member of framework generally having a T-shaped cross section and including a trim board 62 connected on one side to a square post 60. As illustrated, buttons 12 and frame elements 20 of the framing system 10 are attached to the post 60 on opposing sides 64, 66. Furthermore, frame elements 20 are oriented so that side 30 of frame element 20 faces out with relation to the post 60 and the spline grooves 26 and splines 52 face in with relation to the trim board 62. Thus, the spline grooves 26 and splines 52 become concealed from external view. Trim board 62 is dimensioned so as to conceal the frame elements 20 from view. Accordingly, trim board 62 extends horizontally beyond each of the opposing sides 64, 66 of the post 60 by a length that is at least the same as or greater than the length of any one side of the frame element 20. For purposes of installation, once the frame elements 20 are connected to the post 60 and in place, the screen 50 is applied to the frame elements 20 with a spline 52 in a manner such as the one previously described. Next, the trim board 62 is positioned and connected to the post 60 so as to conceal the frame elements 20 and the spline grooves 26. With the fasteners or buttons 12 effectively concealed, and the framing elements 20 and spline grooves 26 covered from view by the trim board 62, the result is a finished appearance of the screen 50 extending directly out of or being integral with the trim board 62 and main framework.

Figure 6:
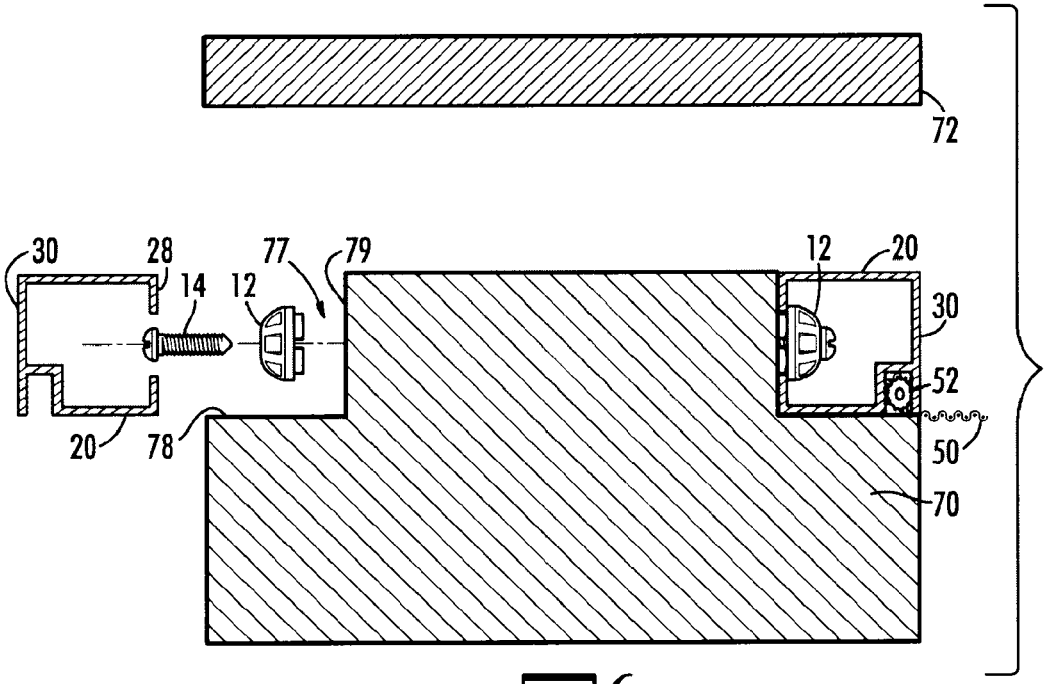
FIG. 6 is an exploded top view of a screen framing system combined with a support member of a framework according to an alternative embodiment.
Figure 7:
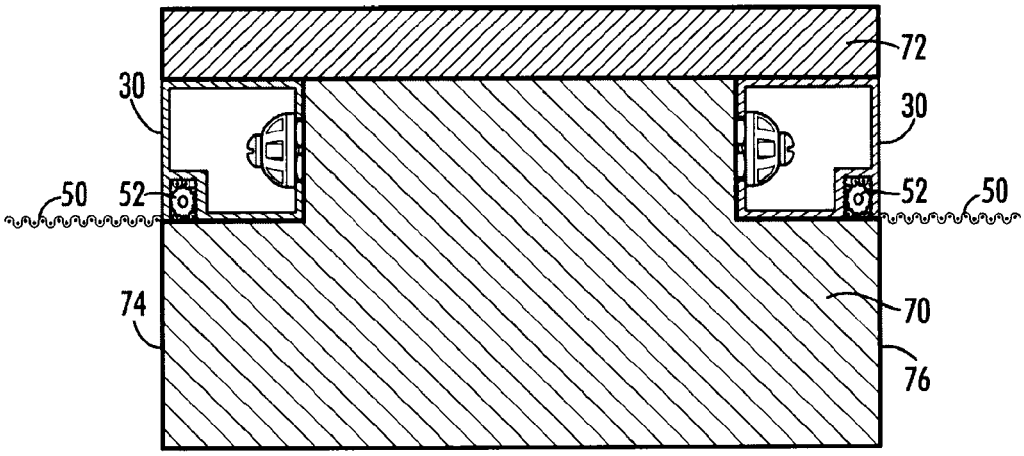
FIG. 7 is a top view of a screen framing system combined with a support member of a framework according to an alternative embodiment.

In a second alternative embodiment shown in FIGS. 6-7, the framing system 10 is combined with a support member of a framework including a trim board 72 connected to one side of a post 70. The post 70 is routed on opposing corners 74, 76 of the one side by frame element-sized cut-outs 77 that are each defined by a first wall 78 and a second wall 79 that are about perpendicular. As described, the cut-outs 77 are preferably dimensioned to both receive and conceal the frame elements 20. Accordingly, dimensions of the cut-outs 77 complement those of the frame elements 20, with the lengths of first and second wall 78, 79, respectively, being about the same as the width and thickness of the frame elements 20. During assembly, buttons 12 are attached to the second wall 79 of the cut-outs 77 and frame elements 20, slot-side-down, including screen 50 are snapped to buttons 12. Frame elements 20 are oriented so that sides 30 of frame elements 20 face out in with relation to the post 70. Thus, the spline grooves 26 and splines 52 become hidden from external view once installed. The trim board 72 is then connected to the post 70 on the side including the cut-outs 77. As shown, the post 70 and trim board 72 are dimensioned to conceal the frame elements 20 from external view. Accordingly, trim board 72 extends horizontally beyond the edges of the one side of the post 70 by a length that is about the same as the length of any one side of frame elements 20. The result is framework with concealed fasteners and having a generally square cross section with a flush, finished appearance of the screen 50 extending directly out of or being integral with the trim board 72 and post 70.

Figure 8:
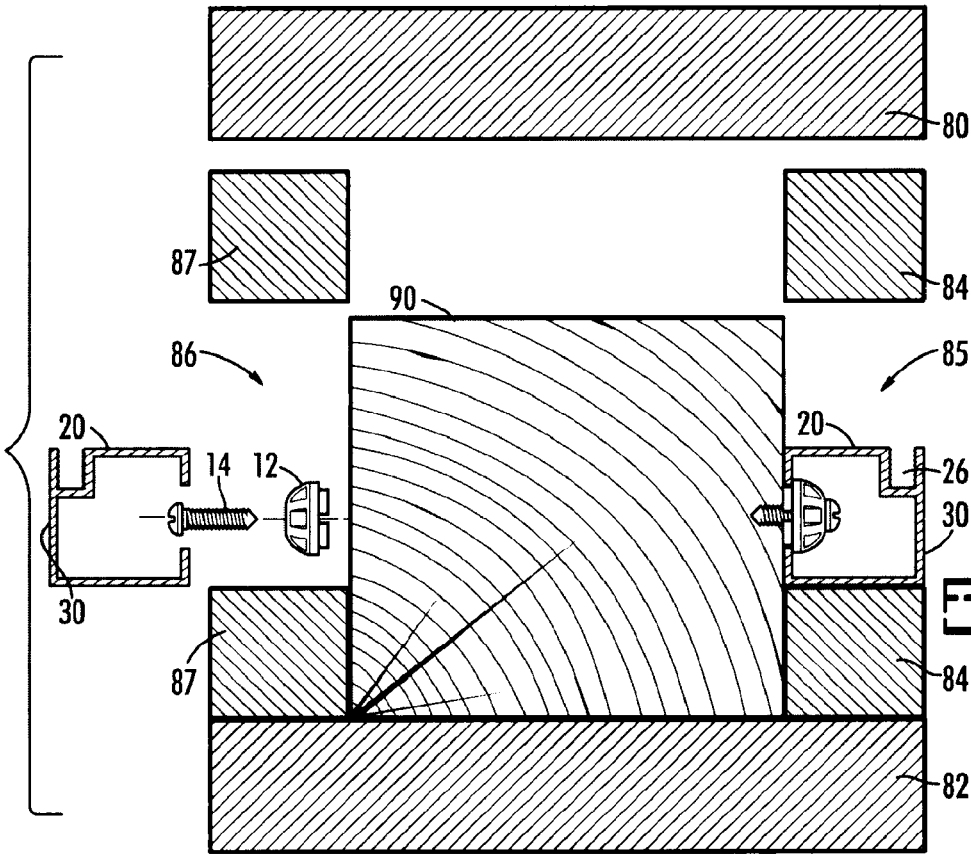
FIG. 8 is an exploded top view of a screen framing system combined with a support member of a framework according to an alternative embodiment.
Figure 9:
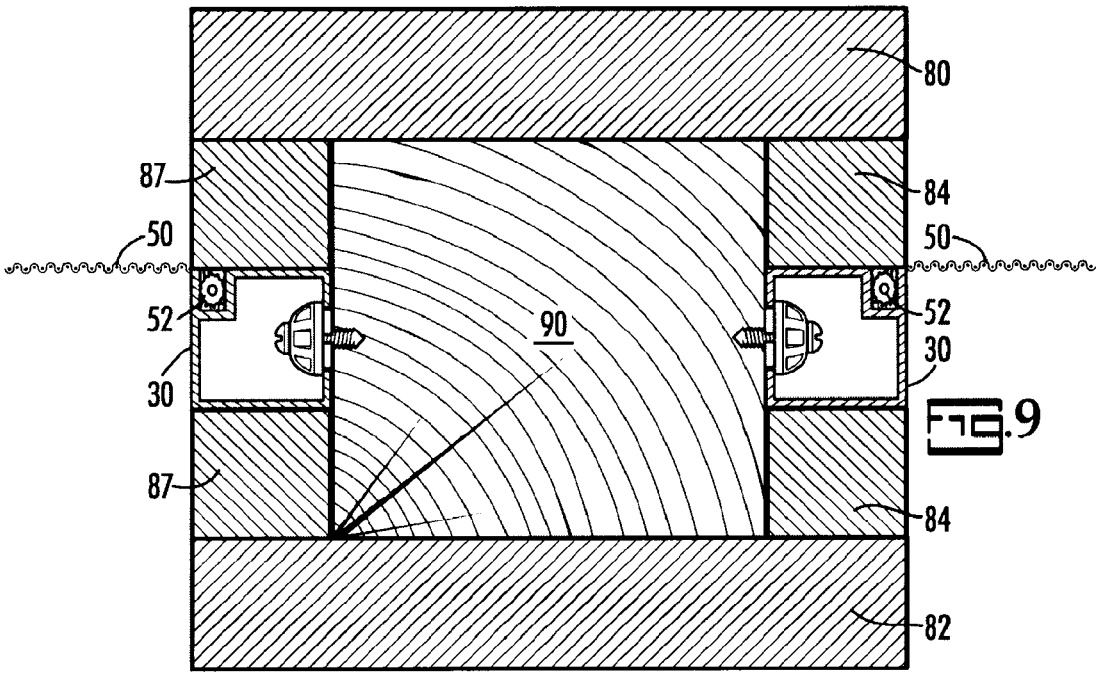
FIG. 9 is a top view of a screen framing system combined with a support member of a framework according to an alternative embodiment.

In a third alternative embodiment shown in FIGS. 8-9, the framing system 10 is combined with a support member of a framework including a post 90 surrounded by a plurality of trim boards connected to the post 90. In particular, the support member includes an outer trim board 80, an inner trim board 82 and side trim boards 84 and 87 that are attached to opposing sides of the post 90, respectively. The side trim boards 84, 87 each have a gap 85 and 86, respectively, dimensioned to receive frame element 20. To assemble the framing system, buttons 12 and frame elements 20 are attached to the post 90 on opposing sides. As with the other embodiments, preferably, sides 30 of the frame elements 20 face out in relation to the post 90 so as to conceal the spline grooves 26 and splines 52 from external view. The side trim boards 84, 87 are then positioned along the post 90 so that frame elements 20 are within and surrounded by the gaps 85, 86 of the boards. To finish the assembly, the outer and inner trim boards 80, 82, each of which have a length sufficient to cover both the central post 90 and the opposing side trim boards 84, 87 from external view, are then connected or joined to the post 90 and side trim boards 84, 87. Importantly, the frame elements 20 fit snugly within the gaps of trim boards 84 and 87, and are no thicker than these boards. Moreover, the outer and inner trim boards 80, 82 are positioned so that side trim boards 84, 87 do not extend horizontally beyond the edges of outer and inner trim boards 80, 82. The effect is to conceal both the side trim boards 84, 87 and the frame elements 20 from view thereby resulting in a flush and finished framework that appears to have screen 50 extending directly out of or being integral with the post 90.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A system for attaching screens to a framework, comprising:

a support member having a surface;

a button attached to said support member, wherein said button includes a head, said head extending above said surface of said support member; and a frame element connected to said button, said frame element having a slot on one side and a spline groove formed in a corner of the opposing side, wherein said slot is dimensioned to receive said button within said slot when said frame element is pressed onto said head of said button, wherein said spline groove has a U-shaped cross section defined by an upper wall and a lower wall connected and spaced apart by a side wall, and wherein the surfaces of said upper wall and said lower wall are ridged.

2. The system as recited in claim 1, wherein said frame element has a square cross section in the shape of a squared letter C with the opening of the C defining said slot.

3. The system as recited in claim 1, wherein said button is a first button spaced apart from a second button.

4. The system as recited in claim 3, wherein said slot extends longitudinally along the length of said frame element so that said head of said first and second buttons may be received in said slot in spaced apart relationship.

5. The system as recited in claim 1, wherein said button carries a screw.

6. The system as recited in claim 5, wherein said screw is integral with said button.

7. The system as recited in claim 1, wherein said button is a screw.

8. The system as recited in claim 1, wherein said head is rounded so that said head forces said slot open when said frame element is pressed thereon.

9. The system as recited in claim 1, further comprising a screen and a spline attached to said spline groove, wherein said spline is resilient and cylindrical with a series of teeth about its exterior surface, and wherein said spline groove is sufficiently narrow so that said spline received therein is held therein by friction.

10. The system as recited in claim 9, wherein a marginal portion of said screen surrounds a major portion of said spline.

11. The system as recited in claim 1, wherein said support member further comprises:

a post;

a trim board connected on one side to said post, wherein said button and said frame element are connected to said post, and wherein said frame element is concealed from external view by said trim board.

12. The system as recited in claim 11, wherein said trim board extends horizontally from said post by a length, wherein said length is at least the same as or greater than the length of any one side of said frame element.

13. The system as recited in claim 1, wherein said support member has a corner routed to form a cut-out dimensioned for receiving said frame element therein, said cut-out having said button attached therein and said frame element pressed onto said button, and wherein said system further comprises a trim board positioned with respect to said frame element and attached to said support member so as to conceal said frame element.

14. The system as recited in claim 13, wherein said frame element cut-out is defined by a first wall and a second wall that are about perpendicular.

15. The system as recited in claim 14, wherein the length and width of said first wall and said second wall, respectively, are about the same as the length and width of said frame element.

16. The system as recited in claim 1, wherein said support member further comprises:

a post;

a plurality of trim boards connected to and surrounding said post, wherein said plurality of trim boards includes an outer trim board, an inner trim board, and two side trim boards, wherein each of said two side trim boards includes a gap dimensioned to receive said frame element; wherein said frame element and said button are two frame elements and at least two buttons that are connected to said post, and wherein said outer trim board, said inner trim board, and said two side trim boards are positioned with respect to said two frame elements and attached to said post so as to conceal said two frame elements from external view.

17. The system as recited in claim 16, wherein said frame element has a width and thickness, and wherein said width and said thickness is about the same as the width and thickness of each of said two side trim boards.

18. The system as recited in claim 17, wherein said thickness is about ¾ inch.

19. A system for attaching a screen to a support post, said system comprising:

at least two buttons, each button of said at least two buttons having a head and a base, said head being wider than said base;

at least two screws, each screw being carried by said each button;

a frame element having a longitudinal length and a slot running along said longitudinal length on one side of said frame element and a spline groove running along said longitudinal length of an opposing side of said frame element, wherein said head of said each button is wider than said slot, so that, when said at least two buttons are fastened in line to a support post with said at least two screws, said frame element can be snapped over said head and onto said base of said each button of said at least two buttons;

a screen; and a spline dimensioned to hold said screen within said spline groove of said frame element.

20. The system as recited in claim 19, wherein said each screw and said each button are integrally formed.

21. The system as recited in claim 19, further comprising trim boards for fastening to said support post to conceal said frame element from view to present a finished appearance.

22. A system for attaching screens to a framework, comprising:

a post;

a trim board connected on one side to said post;

at least one button attached to said post, wherein said at least one button includes a head, said head extending above said surface of said post; and a frame element connected to said button, said frame element having a slot on one side and a spline groove formed in a corner of the opposing side, wherein said slot is dimensioned to receive said at least one button within said slot when said frame element is pressed onto said head of said at least one button, wherein said at least one button and said frame element are connected to said post, and wherein said frame element is concealed from external view by said trim board.

23. The system as recited in claim 1, wherein said at least one button carries a screw.

24. The system as recited in claim 5, wherein said screw is integral with said at least one button.

25. The system as recited in claim 1, wherein said button is a screw.

26. The system as recited in claim 1, wherein said head is rounded so that said head forces said slot open when said frame element is pressed thereon.

27. A system for attaching screens to a framework, comprising:

a support member having a surface;

at least one button attached to said support member, wherein said at least one button includes a head, said head extending above said surface of said support member; and a frame element connected to said at least one button, said frame element having a slot on one side and a spline groove formed in a corner of the opposing side, wherein said slot is dimensioned to receive said at least one button within said slot when said frame element is pressed onto said head of said at least one button, wherein said support member has a corner routed to form a cut-out dimensioned for receiving said frame element therein, said cut-out having said at least one button attached therein and said frame element pressed onto said at least one button.

28. A system for attaching screens to a framework, comprising:

a support member, wherein said support member is a post, said post being connected to and surrounded by a plurality of trim boards, wherein said plurality of trim boards includes an outer trim board, an inner trim board, and two side trim boards;

a button attached to said support member, wherein said button includes a head, said head extending above said surface of said support member; and a frame element connected to said button, said frame element having a slot on one side and a spline groove formed in a corner of the opposing side, wherein said slot is dimensioned to receive said button within said slot when said frame element is pressed onto said head of said button, wherein each of said two side trim boards includes a gap dimensioned to receive said frame element; wherein said frame element and said button are two frame elements and at least two buttons that are connected to said post, and wherein said outer trim board, said inner trim board, and said two side trim boards are positioned with respect to said two frame elements and attached to said post so as to conceal said two frame elements from external view.

* * * * *

UNITED STATES PATENT AND TRADEMARK OFFICE

CERTIFICATE OF CORRECTION

PATENT NO. : 7,861,473 B1
APPLICATION NO. : 12/353313
DATED : January 4, 2011
INVENTOR(S) : Guerry E. Green It is certified that error appears in the above-identified patent and that said Letters Patent is hereby corrected as shown below:

Title Page Assignee should read-
Marhaygue, LLC
Pawleys Island, SC

Signed and Sealed this
Nineteenth Day of April, 2011

David J. Kappos

David J. Kappos
*Director of the United States Patent and Trademark Office*